United States Patent [19]

Boggs et al.

[11] Patent Number: 4,789,371

[45] Date of Patent: Dec. 6, 1988

[54] SIMULATED TOY FLASH CAMERA

[75] Inventors: Robert J. Boggs; Janet E. Snell-Kelly, both of E. Aurora, N.Y.

[73] Assignee: The Quaker Oats Company, Chicago, Ill.

[21] Appl. No.: 101,989

[22] Filed: Sep. 29, 1987

[51] Int. Cl.[4] ..... A63H 33/30; A63H 33/22

[52] U.S. Cl. ..... 446/219; 446/408; 446/486

[58] Field of Search ..... 446/219, 408, 485, 491; 350/97, 98; D16/6; D21/73, 110, 145; 272/8 M, 8 P, 8.5

[56] References Cited

U.S. PATENT DOCUMENTS

| | | | |
|---|---|---|---|
| 2,602,265 | 7/1952 | Jackson | 446/408 |
| 2,853,832 | 9/1958 | Arena | 446/408 |
| 2,939,244 | 6/1940 | Grimes et al. | 446/408 |
| 3,114,216 | 12/1963 | Crawford et al. | 446/408 |
| 3,490,171 | 1/1970 | Crawford et al. | 446/408 |
| 4,508,518 | 4/1985 | Exevea | 446/485 |

*Primary Examiner*—Robert A. Hafer
*Assistant Examiner*—Michael Brown
*Attorney, Agent, or Firm*—Cumpston & Shaw

[57] ABSTRACT

A toy simulated flash camera is disclosed for simulating the flash exposure of a real camera. The toy camera has a flash housing containing a light reflecting member which is visible through a front opening in the front wall of the flash housing. The toy flash camera further has a top opening in the top wall of the flash housing. A flash shutter mechanism is provided for the top opening which is movable between a normal shutter closed position for preventing the passage of ambient light through the top opening into engagement with an outer surface of the light reflecting member, and a shutter open position allowing the passage of ambient light through the top opening. A flash shutter actuating mechanism is provided for momentarily moving the flash shutter mechanism to its shutter open position causing the ambient light momentarily reflected from the outer surface of the light reflecting member through the front opening to simulate a real flash lamp exposure.

10 Claims, 3 Drawing Sheets

FIG. 1A
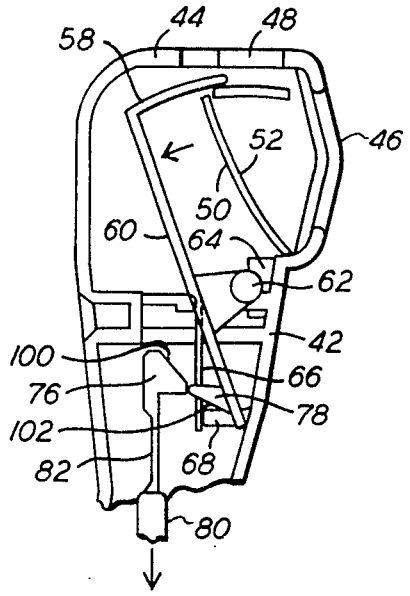
FIG. 1B
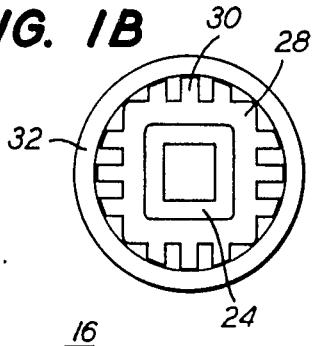
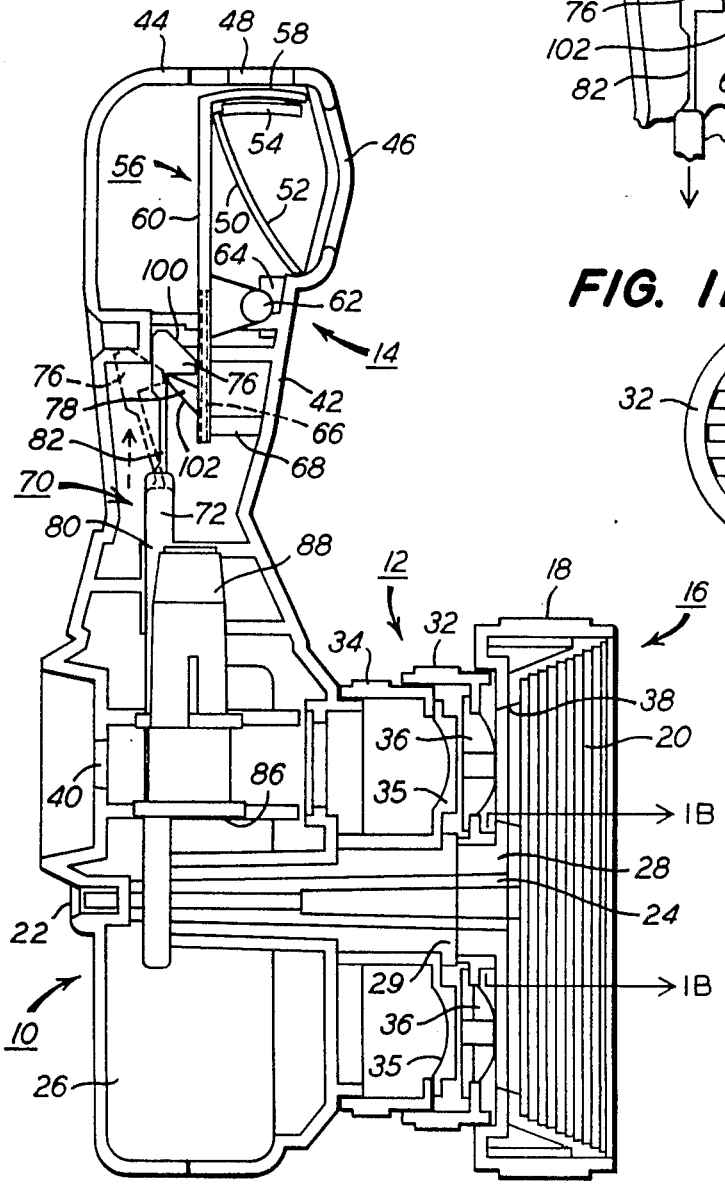
FIG. 1

SIMULATED TOY FLASH CAMERA

FIELD OF THE INVENTION

The present invention relates generally to toys, and more specifically to a toy flash camera that simulates flash exposures.

BACKGROUND OF THE INVENTION

Children tend to spend a considerable amount of their time indulging in fantasy and the world of make-believe. To indulge their fantasy, the toy industry is challenged to provide toys that closely simulate the real counterparts enjoyed by the adult world.

Cameras are well known in the art, along with the capability of providing a flash of illumination in those instances where the ambient light is insufficient to properly expose the film. A need has existed for some time in the toy industry for a toy camera that simulates the flash exposure of a real camera, without the use of lamps, batteries or the like.

Therefore, an object of the present invention is to provide a toy camera that simulates a real camera having manually adjustable rings to simulate setting the exposure, and an exposure button adapted when depressed to actuate a flash shutter mechanism causing momentary ambient light to be reflected from the outer surface of a light reflecting member to simulate a real flash lamp exposure.

SUMMARY OF THE INVENTION

One or more objects of this invention are accomplished by providing a toy simulated flash camera comprising:

a camera body having a flash housing with a front wall and a top wall;

a light reflecting member in the flash housing having an outer light reflecting surface;

a front opening in the front wall through which the light reflecting member is visible;

a top opening in the top wall;

a flash shutter mechanism in the flash housing movable between a normal shutter closed position for preventing the passage of ambient light through the top opening into engagement with the outer surface of the light reflecting member, and a shutter open position allowing the passage of ambient light through the top opening into engagement with the outer surface of the light reflecting member where it is reflected outwardly through the front opening in the form of a flash; and flash shutter actuating means for momentarily moving the flash shutter mechanism to its shutter open position causing the momentary ambient light reflected from outer surface of the light reflecting member through the front opening to simulate a real flash lamp exposure.

A more specific object of the invention is to provide a toy simulated flash camera in which the flash shutter mechanism comprises a shutter member of substantially inverted L-shaped cross section having a first shutter plate member interposed between the top opening in the top wall and a light focusing lens. The shutter member further has a second shutter plate member integral with and transverse to the first shutter plate member. The second shutter plate member is mounted for pivotal movement for moving the first shutter plate member between shutter open and shutter closed positions. A flash shutter member actuating means comprises a third shutter actuating plate member having a claw at one end thereof. The shutter actuating plate member is reciprocally movable from a normal position in which the claw faces a hook on the free end portion of the second shutter plate member. The claw pivotally moves the hook and shutter member to its open position upon movement of the shutter actuating plate member in one direction from its normal position to a simulated flash picture-taking position, at which time the claw slips past the hook. Spring means are provided for returning the shutter actuating plate member to its normal position while the claw is below the hook.

BRIEF DESCRIPTION OF THE DRAWINGS

In the detailed description of the invention presented below, reference is made to the accompanying drawings, in which:

FIG. 1 is a side-elevational view in section of a preferred embodiment of a toy simulated flash camera of this invention;

FIG. 1A is a segmental side-elevational view in section of a portion of the camera of FIG. 1 showing the flash shutter mechanism in its shutter open position;

FIG. 1B is a section view taken substantially along line 1B—1B of FIG. 1 showing the bearing about which the optical lens ring is rotated;

DETAILED DESCRIPTION OF THE INVENTION

Figure 2:
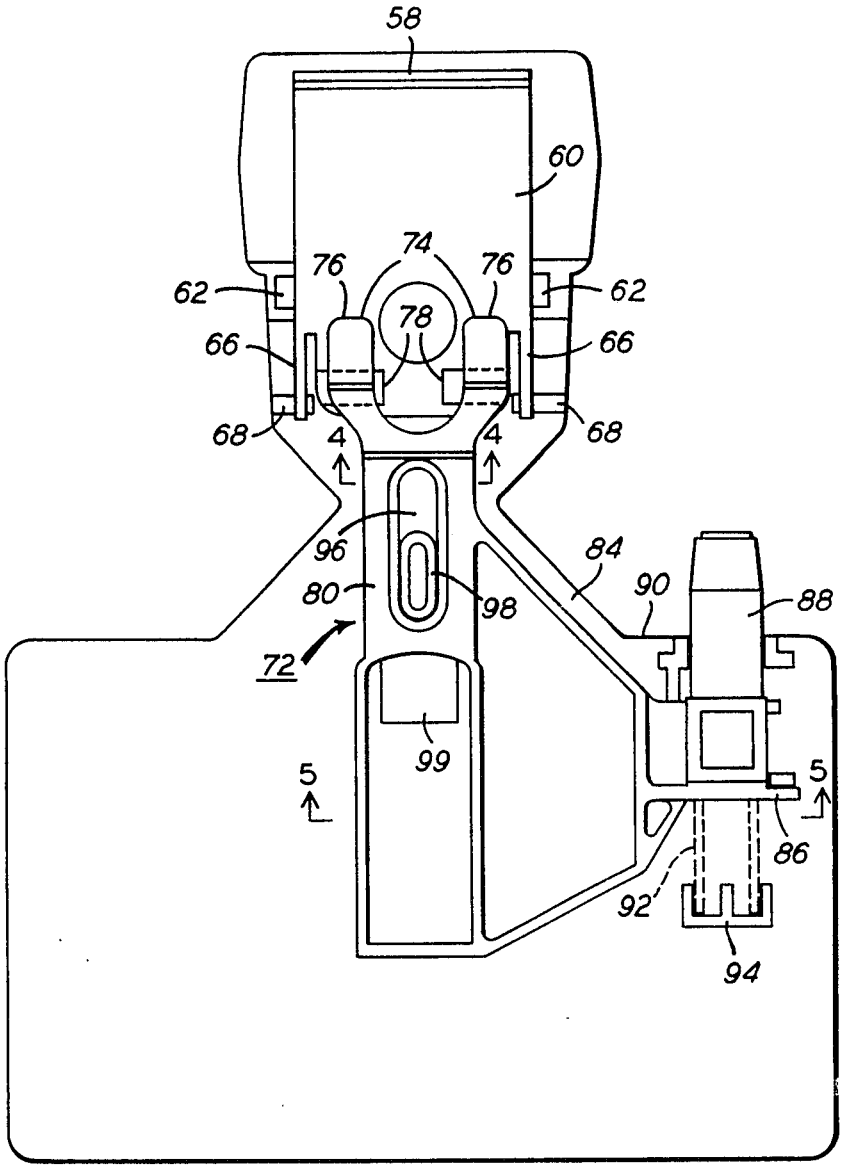
FIG. 2 is a rear-elevational view of the toy flash camera of FIG. 1 with body portions thereof omitted to show the flash shutter mechanism and flash shutter actuating means therefor.

With reference to FIGS. 1 and 2, a preferred embodiment of a toy flash camera of this invention is disclosed comprising a substantially rectangular body 10, a lens unit 12 extending from the front wall of the body, and a flash housing 14 extending upwardly from the camera body.

The lens unit 12 comprises a cylindrical cup-shaped fixed front end portion 16 in which a rim 18 thereof has an inner decorative scalloped surface 20. A rear wall 22 of the front end portion has a post 24 of square-shaped cross section secured thereto with the outer end thereof secured to a rear wall 26 of camera body 10. A bearing sleeve 28, as best shown in FIG. 1B, is mounted on post 24 and has a circular ribbed peripheral surface 30 for rotatably supporting doughnut-shaped optical effect lens ring 32 with a minimum of friction. A filter lens ring 34 having a plurality of filters 35 of different colors is mounted on a similar bearing sleeve 29 which also provides a spacer between the lens rings. The lens ring 32 has a plurality of angularly spaced optical lens elements 36 of varied design which may be rotatably positioned into alignment with an opening 38 in fixed front end portion 16, and an eye viewing opening 40 in rear wall 26 of camera body 10. The varied optical lens elements 36 give the child camera operator optical illusions of the subject viewed through eye-viewing opening 40. The lens rings 32, 34 can be provided with any suitable detents, not shown, for selectively positioning the lens and filter elements 35, 36 into alignment with viewing openings 38, 40.

The flash housing 14 comprises front and top walls 42, 44 respectively having front and top openings 46, 48 respectively. Mounted within the upper end of flash housing 14 is a curved reflector member 50, of which the inner concave reflecting surface 52 is covered with any suitable embossed light reflecting material, such as aluminum foil, for example. Mounted within flash housing 14 in register with top opening 48 in top wall 44 is a lenticular diffusing lens element 54 for focusing ambient light entering top opening 48 against reflecting surface 52 which reflects the light through front opening 46.

Figure 3:
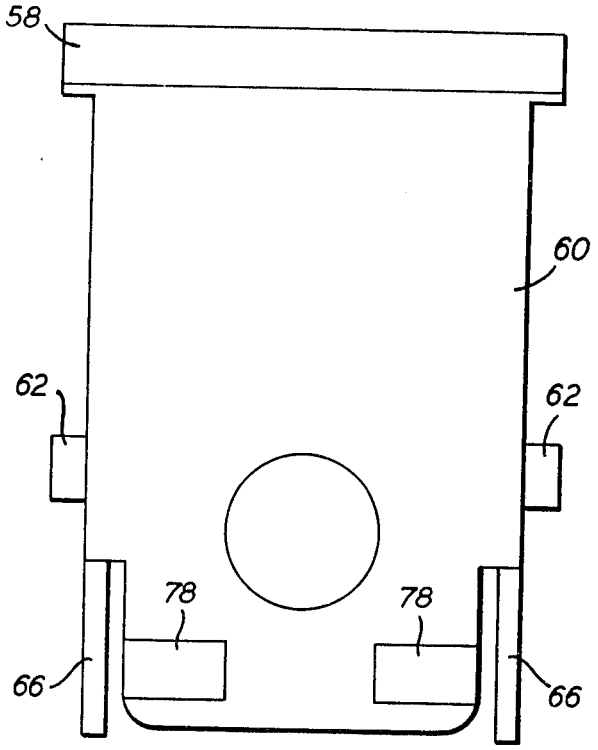
FIG. 3 is a rear-elevational view of the shutter mechanism.
Figure 4:
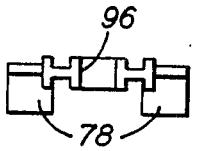
FIG. 4 is a section view of only the flash shutter actuating means taken substantially along line 4–4 of FIG. 2.

A flash shutter mechanism 56 is mounted within flash housing 14, and comprises an inverted substantially L-shaped member having a curved first plate member 58 interposed between top wall 44 and light focusing lens 54 in the normal shutter closed position of the shutter mechanism, as seen in FIG. 1. The shutter mechanism 56 further has a second plate member 60 transverse to and integral with first plate member 58. Plate member 60 is pivotally mounted within flash housing 14 on stub shafts 62 rotatably mounted in journals 64 extending from front wall 42 of flash housing 14 perferably, to enhance the realism of the flash effect, at least one front and top opening 46, 48 is covered with a layer of translucent colored material. In the normal shutter closed position of flash shutter mechanism 56, the shutter plate member 58 blocks top opening 48 preventing ambient light from entering the top opening. The shutter plate member 60 further has integral spring arms 66, as best seen in FIG. 3, engagable with the ends of complementary posts 68 in flash housing 14 for biasing shutter mechanism 56 to its normal shutter closed position.

With reference to FIGS. 1, 2, 4 and 5, a flash shutter actuating means 70 for momentarily moving shutter mechanism 56 to its shutter open position (FIG. 1A) causing ambient light to be momentarily reflected from light reflecting surface 52 of light reflecting member 50 through front opening 46 to simulate a flash lamp exposure, will now be described. The flash shutter actuating means 70 comprises a generally flat third shutter actuating plate member 72 having an upper forked end 74 in which each end portion is provided with a claw 76, as best seen in FIG. 1. Each claw 76 engages a mating hook 78 on the lower end of shutter plate member 60. The forked end portions 74 are connected to a body portion 80 of shutter actuating plate member 72 by a flexible necked-down section 82. Plate member 72 is slidably mounted on support surfaces, not shown, on the front and rear walls of body 10 and flash housing 14.

Figure 5:
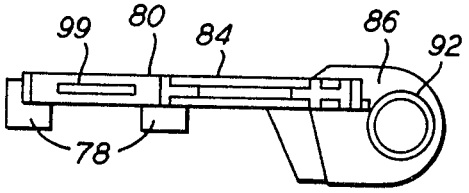
FIG. 5 is a section view similar to FIG. 4 taken substantially along line 5–5 of FIG. 2.

The lower end of shutter actuating plate member 72 has a laterally extending fin 84 integral with a shelf 86 supporting a vertically upstanding hollow button 88, as best seen in FIGS. 2 and 5. The button extends through an upper wall 90 in camera body 10. Shutter actuating plate member 72 and button 88 are biased upwardly into a normal non-exposure position, shown in FIGS. 1 and 2, by a spring 92. Spring 92 has one end secured to a fixed support 94 in camera body 10, and the opposite end extending into the hollow of button 88 and engageable with a shoulder therein, not shown. The spring 92 forces shutter actuating plate member 72 upwardly until the lower end of an elongated slot 96 in body portion 80 of shutter actuating plate member 72 engages an oblong shaped guide post 98 extending from front wall 42 of flash housing 14. In this normal position, as best seen in FIG. 1, the shutter actuating claws 76 are in engagement with mating hooks 78 at the lower end of shutter plate member 60.

The lower end of shutter actuating plate member 72 further has a depending flag 99 (see FIG. 2) in alignment with eye-viewing opening 40. When plate member 72 is depressed to make a flash exposure, flag 99 blocks eye-viewing opening 40 while the flash exposure is taking place giving the child operator the perception of the shutter opening and closing.

When button 88 is manually depressed to make a flash exposure, hooks 78 ae moved downwardly pivoting shutter plate member 60 into the position shown in FIG. 1A, in which flash shutter mechanism 56 is in its open position allowing ambient light to pass through top opening 48. Continued movement of button 88 downwardly causes claws 76 to move past hooks 78, whereupon tensioned shutter plate spring arms 66 return flash shutter mechanism 56 to its normal closed position blocking the passage of light through top opening 48. When button 88 is released, ramp surfaces 100 on claws 76 engage lower inclined surfaces 102 of hooks 78 causing the claws to flex laterally outwardly, as seen dotted in FIG. 1, away from and around the hooks. Upon clearing the hooks, the claws flex back into the normal position shown in FIGS. 1 and 2. During this momentary opening of flash shutter mechanism 56, ambient light passes through top opening 48 and lens 54 and is reflected from the concave reflecting surface 52 or reflecting member 50 through front opening 46 where it appears as a momentary flash simulating a flash exposure.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy simulated flash camera comprising:

a camera body having a flash housing with a front wall and a top wall;

a light reflecting member in the flash housing having an outer light reflecting surface;

a front opening in the front wall through which the light reflecting surface of the light reflecting member is visible;

a top opening in the top wall;

a shutter mechanism in the flash housing movable between a normal shutter closed position for preventing the passage of ambient light through the top opening into engagement with the outer surface of the light reflecting member, and a shutter open position for allowing the passage of ambient light through the top opening into engagement with the outer surface of the light reflecting member where it is reflected outwardly through the front opening in the form of a flash; and shutter actuating means for momentarily moving the shutter mechanism from its normal shutter closed position to its shutter open position causing the momentary ambient light reflected from the outer surface of the light reflecting member through the front opening to simulate a flash lamp exposure.

2. A toy simulated flash camera according to claim 1 wherein at least one of the top and front openings is covered with a layer of translucent colored material.

3. A toy simulated flash camera according to claim 2 wherein the layer of material has an orange-like color.

4. A toy simulated flash camera according to claim 3 wherein the layer of material comprises a lens for focusing the light on the outer surface of the reflecting member, and the outer surface of the reflecting member is concave.

5. A toy simulated flash camera according to claim 4 wherein the shutter mechanism comprises a shutter member of substantially inverted L-shaped cross section.

6. A toy simulated flash camera according to claim 5 wherein the shutter member in its normal shutter closed position comprises a first plate member interposed between the top opening and the lens, and a second plate member integral with and transverse to the first plate member, the second plate being mounted for pivotal movement for moving the shutter member between its normal shutter closed and shutter open positions.

7. A toy simulated flash camera according to claim 6 wherein the second plate member has a free end portion, and a spring arm on the free end portion for biasing the shutter member into its normal shutter closed position.

8. A toy simulated flash camera according to claim 7 wherein the second plate member has a hook on the free end portion, and the shutter actuating means comprises a third plate member having a claw at one end thereof, the third plate member being reciprocally movable from a normal position in which the claw faces the hook, for engaging the hook and pivotally moving the shutter member to its normally open position upon movement of the third plate member in one direction from its normal position to a simulated flash picture-taking position.

9. A toy simulated flash camera according to claim 8 wherein the claw is flexible and has a ramp surface allowing the claw to flex around the hook upon return movement of the third plate member in the opposite direction to its normal position.

10. A toy simulated flash camera according to claim 9 wherein the third plate member has a simulated manually operated picture-taking button extending outwardly from the camera for movement of the third plate member from its normal position to its flash picture-taking position, and spring means are coupled to the third plate member for returning it to its normal position upon release of the button.

* * * * *